US006588219B2

(12) United States Patent
Zevlakis

(10) Patent No.: US 6,588,219 B2
(45) Date of Patent: Jul. 8, 2003

(54) COMMERCIAL ICE MAKING APPARATUS AND METHOD

(76) Inventor: John Zevlakis, 21-09 19th St., Astoria, NY (US) 11105

( * ) Notice: Subject to any disclaimer, the term of this patent is extended or adjusted under 35 U.S.C. 154(b) by 0 days.

(21) Appl. No.: 10/068,952

(22) Filed: Feb. 9, 2002

(65) Prior Publication Data

US 2003/0106327 A1 Jun. 12, 2003

Related U.S. Application Data

(60) Provisional application No. 60/339,855, filed on Dec. 12, 2001.

(51) Int. Cl.[7] ..... F25C 1/12

(52) U.S. Cl. ..... 62/73; 62/352; 249/81; 249/119

(58) Field of Search ..... 62/73, 74, 347, 62/348, 352; 249/81, 119, 120, 129

(56) References Cited

U.S. PATENT DOCUMENTS

| | | | | |
|---|---|---|---|---|
| 1,781,541 A | | 11/1930 | Einstein | |
| 1,852,064 A | | 4/1932 | Rosenberg | |
| 1,977,608 A | | 10/1934 | Blystone | |
| 2,069,567 A | | 2/1937 | White | |
| 2,112,263 A | | 3/1938 | Bohannon | |
| 2,586,588 A | | 2/1952 | Weseman | |
| 2,941,377 A | | 6/1960 | Nelson | |
| 3,003,327 A | | 10/1961 | Cox | |
| 3,130,556 A | | 4/1964 | Goldsborough | |
| 3,220,214 A | | 11/1965 | Cornelius | |
| 3,318,105 A | | 5/1967 | Burroughs | |
| 3,430,452 A | | 3/1969 | Dedricks | |
| 3,775,992 A | * | 12/1973 | Bright | 62/73 |
| 3,913,349 A | | 10/1975 | Johnson | 62/352 |
| 3,959,981 A | | 6/1976 | Anderson | 62/135 |
| 4,048,815 A | | 9/1977 | Kattis | 62/354 |
| 4,055,053 A | | 10/1977 | Elfring | 62/3 |
| 4,199,956 A | | 4/1980 | Lunde | 62/138 |
| 4,255,941 A | | 3/1981 | Bouloy | 62/347 |
| 4,366,679 A | | 1/1983 | Van Steenburgh | 62/347 |
| 4,459,824 A | | 7/1984 | Krueger | 62/347 |
| 4,474,023 A | | 10/1984 | Mullins | 62/137 |
| 4,580,410 A | | 4/1986 | Toya | 62/347 |
| 4,628,698 A | * | 12/1986 | Needham et al. | 62/137 |
| 4,774,814 A | | 10/1988 | Yingst | 62/126 |
| 4,942,742 A | * | 7/1990 | Burruel | 62/347 |
| 5,218,830 A | | 6/1993 | Martineau | 62/73 |
| 5,582,754 A | | 12/1996 | Smith | 219/438 |
| 5,666,819 A | | 9/1997 | Rockenfeller | 62/480 |
| 6,233,964 B1 | | 5/2001 | Ethington | 62/344 |

* cited by examiner

*Primary Examiner*—William E. Tapolcai
(74) *Attorney, Agent, or Firm*—Alfred M. Walker

(57) ABSTRACT

A high throughput, short batch cycle commercial ice making machine produces commercial ice which resists melting in convenient sizes for mobile food carts, market produce, or fish displays. The machine introduces super-cooled water, that is in a liquid state while exposed to a temperature below freezing, into a batch of pre-formed hollow molds of one or more horizontally oriented ice forming freezing trays oriented horizontally. Using vapor compression refrigeration, the machine produces a plurality of supercooled ice segments in pockets within the freezing tray. The supercooled ice segments are rapidly subjected to a short, temporary contact with a high heat source from a sleeve integral with the freezing tray compartments, along a peripheral bottom surface of the ice segment accommodating freezing tray molds. This temporarily melts a bottom surface of each ice segment, lubricating it and loosening it. Then the machine rotates the freezing tray containing the batch of ice segments about its horizontally oriented axis to a vertically oriented dump position, thereby dumping the temporarily heated ice segments into the freezing tray.

18 Claims, 8 Drawing Sheets

COMMERCIAL ICE MAKING APPARATUS AND METHOD

This application claims benefit of Prov. No. 60/339,855 filed Dec. 12, 2001.

FIELD OF THE INVENTION

The present invention relates to making ice cubes in a horizontally oriented freezing tray having refrigerant and evaporator conduits integral with, and in intimate contact with, the ice cube mold compartments of a freezing tray, so that the resultant ice cubes have a long shelf life before melting.

BACKGROUND OF THE INVENTION

Commercial ice in convenient sizes for mobile food carts, market produce, or fish displays is needed in large quantities. However, especially in warm weather, the ice melts quickly and must be replenished several times per day.

Many ice making machines make ice in vertically oriented freezing trays. In vertical dripping, the later dripped water freezes differently than the earlier dripped water in a vertical cascade. In addition, freezing is inhibited because the vertical inflow of water releases more energy as the water cascades down, thus slowing the freezing time due to the activity of the flowing, cascading water.

Among relevant vertically oriented ice making patents include U.S. Pat. No. 4,474,023 of Mullins for an ice making machine. In Mullins '023, ice is formed by dripping water in vertically disposed trays, freezing the water into cubes, loosening the cubes by applying heat through adjacent evaporator conduits, then rotating the trays approximately 30 degrees downward from a vertical position, thereby dumping the formed ice cubes into a bin. Flexible hoses are used in Mullins '023 for transporting both the water and the refrigerant in order to allow pivoting of the freezing tray from the vertical water loading position to the partially face-down dumping position. Mullins '023 uses a high heat source in a cycle reversal for causing temporary loosening of the cubes from their individual molds within the tray, but the evaporator is attached to the tray, not integrally formed therewith. As a result, the tray contacting surface of the ice cubes is not uniformly and quickly heated for a quick melt and release therefrom.

A similar ice cube making machine with a vertically oriented freezing tray is described in U.S. Pat. No. 4,459,824 of Krueger. However, the vertical orientation of Mullins '023 and Krueger '824 increases drip inflow time, which provides a barrier to super-cooling of the water for forming the ice.

U.S. Pat. No. 4,255,941 of Bouloy describes an ice making machine which is vertically oriented. In Bouloy '941, there are shown two freezing trays 22 welded back-to-back, wherein the trays 22 with semi-circular molds 32 for each ice cube have spaces 48 between the trays 22 for a reverse flow of alternately flowing refrigerant and evaporator gas. The hot gas is used to melt the ice cubes 124 from their molds 32 in each of the two back-to-back freezing trays 22.

The spaces 48 of Bouloy '941 are arcuate triangles formed between the rounded backs of the semi-circular molds 32 forming the ice cubes.

The disadvantage of Bouloy '941 is that since the two molds are welded back-to-back, at the weld seams between the two molds each labeled 22, the refrigerant and alternately the hot gas can't flow through these closed seams, so there is not uniform intimate contact of the hot gas with the bottom of each ice cube mold 32 of each of the freezing trays 22.

U.S. Pat. No. 4,199,956 of Lunde describes an ice cube making machine which requires an electronic sensor to interrupt the freezing cycle to thaw the cubes for dumping.

U.S. Pat. No. 6,233,964 of Ethington describes an ice cube making machine with a freezing cycle and a hot gas defrost valve used with a detector for detecting frozen ice. Ethington '964 is similar to conventional ice making machines in hotels and other commercial establishments.

Among other U.S. Patents for loosening frozen ice cubes from a tray ice include U.S. Pat. No. 3,220,214 of Cornelius for a spray type ice cube maker.

Moreover, among patents which heat trays for loosening ice cubes include U.S. Pat. No. 5,582,754 of Smith, which uses electrical heating elements to thaw semi-circular ice cubes from a freezing tray. In addition, U.S. Pat. No. 1,852,064 of Rosenberg, U.S. Pat. No. 3,318,105 of Burroughs, U.S. Pat. No. 2,112,263 of Bohannon U.S. Pat. No. 2,069,567 of White and U.S. Pat. No. 1,977,608 of Blystone also use electrical heating elements to thaw cubic ice cubes from a freezing tray. In Bohannon '263, Burroughs '105 and White '567, the electrical heating elements are arrayed in longitudinally extending heating elements which extend adjacent to the sides and bottoms of ice cube freezing tray ice cube forming compartments, but the heating elements do not provide uniform heat all along an undersurface of each ice cube tray compartment.

U.S. Pat. No. 2,941,377 of Nelson uses serpentine conduits of evaporation fluid for loosening ice cubes, but only along the sides of the ice cube tray molds.

U.S. Pat. No. 1,781,541 of Einstein, U.S. Pat No. 5,218,830 of Martineau and U.S. Pat No. 5,666,819 of Rockenfeller and U.S. Pat. No. 4,055,053 of Elfving describe refrigeration units or ice making machines which utilize heat pumps for alternate heat and cooling.

Therefore, the prior art patents have the disadvantage of not allowing for supercooling of water on a horizontally oriented tray, and not allowing for rapid but effective heating of all of the undersurface of each ice cube from adjacent evaporator conduits conforming to the surface of the ice cube forming tray compartment molds, to provide only a slight melting of the undersurface of each ice cube for lubricating each cube prior to dumping in a supercooled state into a collection harvesting bin.

Furthermore, among the vertically oriented ice making machines such as of Mullins '023 or Bouloy '941, there is no way to use the freezing trays horizontally as a display counter, such as in a fish market or retail store.

OBJECTS OF THE INVENTION

It is therefore an object of the present invention to provide super-cooled ice cubes with a long shelf life before melting, and to improve over the disadvantages of the prior art.

It is yet another object of this invention to maximize the use of a horizontally oriented freezing tray of an ice making machine, wherein the horizontally oriented freezing tray has integral hollow sleeves in intimate contact with the freezing tray, to facilitate the rapid freezing and discharge of the ice from the freezing tray.

Other objects which become apparent from the following description of the present invention.

SUMMARY OF THE INVENTION

In keeping with these objects and others which may become apparent, the present invention is an efficient method of producing this commodity of melt-resistant ice is described by this invention. The method and apparatus of this invention uses one or more horizontally oriented freezing trays in combination with conventional vapor compression refrigeration using common refrigerants such as, for example, "Free Environmental Refrigerant number 404A". The quality of the product is superior as the apparatus outputs ice segments that are supercooled (below or near 0 degrees F.) well below freezing temperature thus affording even more cooling capacity per pound than just the heat absorbed by the solid to liquid transition. The ice is produced in batches in horizontally oriented freezing trays, wherein the batches are then dumped automatically from the freezing trays.

Because the freezing trays are horizontally oriented, the water is dripped at a uniform rate, unlike cascading water flowing down vertically oriented freezing trays. These he horizontally oriented freezing trays can also be used as counters for displaying objects kept at cold temperatures, such as fish at a fish market or retail store. Moreover, these horizontally oriented freezing trays can be stacked horizontally one on top of each other for maximum use.

The rapid cycle time achieved insures very good capital efficiency as the weight of ice produced per day is high with respect to the cost of the apparatus.

Key elements of this invention that contribute to its superior performance include the design of the freezing trays which form an integral evaporator, as well as the method of dumping the ice product by rotating the tray from the horizontal to a vertical position. This rotation is facilitated by the use of flexible coolant hose connections to the freezing trays.

By cycle reversal (similar to a heat pump cycle), hot refrigerant is directed into the evaporation spaces in the trays for a brief "thaw" cycle which creates a thin layer of water at the interface between the ice segment and the tray surface thereby dislodging the ice segment while the tray is in the vertical position with the water layer acting as a "lubricant" to further aid in the dumping process. Since the "thaw" cycle has very high heating power causing a high temperature difference between the heated tray surface and the ice segment, this cycle is short, and the heating of the ice surface is therefore localized to a thin liquid interface layer which quickly refreezes upon being dumped due to heat transfer to the interior of the supercooled ice segment.

Therefore, to summarize the key features, integral evaporation channels within the horizontally oriented freezing trays contribute to short freezing cycles; rotation of freezing trays is facilitated by coolant hose connections; dumping of ice product is accomplished by refrigeration cycle reversal heating freezing trays internally; product produced is convenient sized ice segments that are supercooled.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
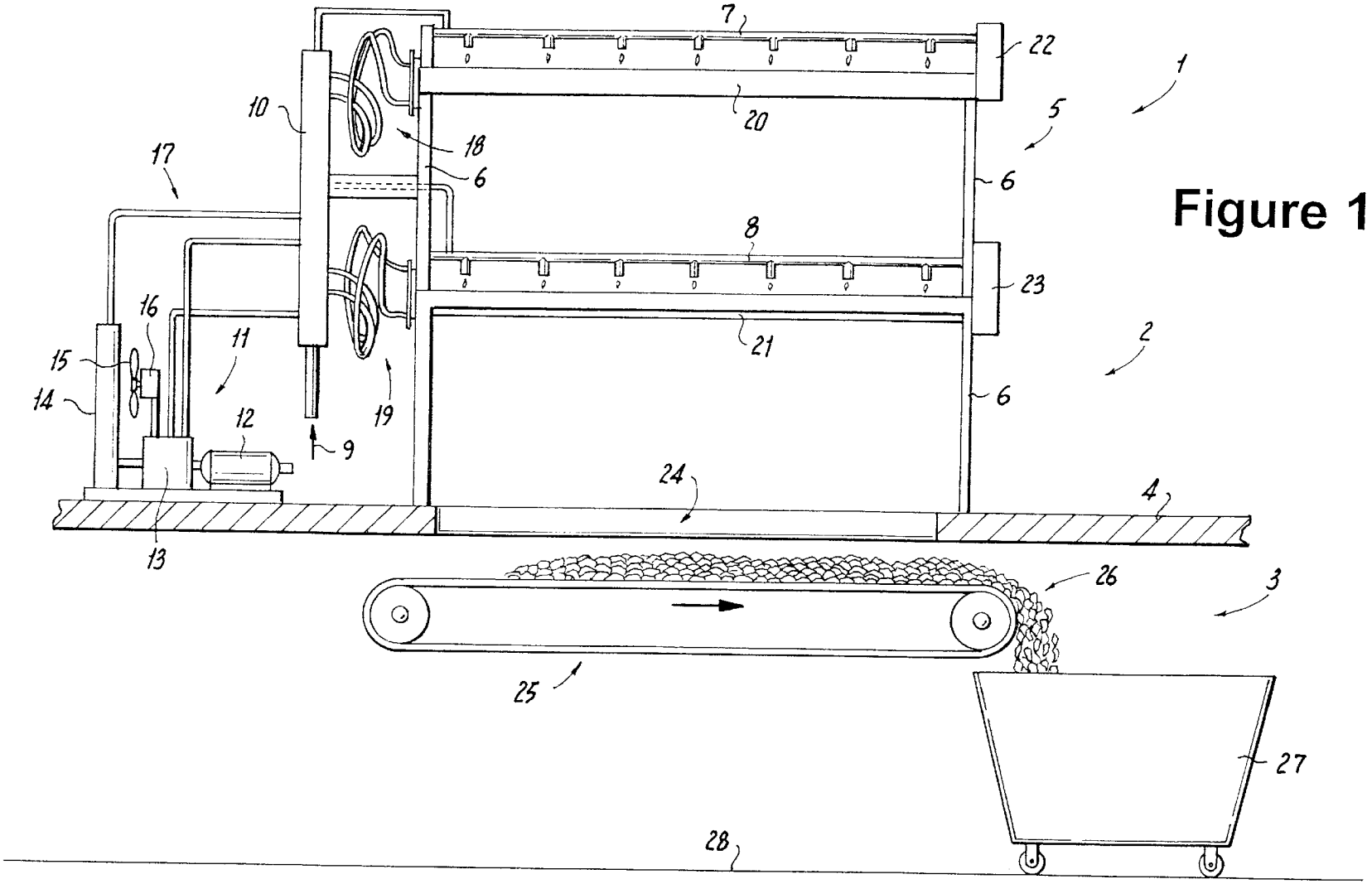
FIG. 1 is a Side elevation view of an ice making system of this invention.

FIG. 1 presents an illustration of an embodiment of this invention as a complete ice making system 1 housed on an upper floor 2 and a lower floor 3 of a building. The ice making apparatus 5 rests on support floor 4 which has a large opening communicating with the floor 3 below. Under this opening is conveyor belt 25 which moves dumped ice segments 26 to bin 27 which rests on the lower floor surface 28. A vapor compression refrigeration system 11 (part of ice making apparatus 5) includes compressor motor 12, compressor 13, fan motor 16, fan 15, heat exchanger 14, and rigid refrigerant lines 17.

Frame 6 supports a horizontally oriented lower ice tray 21 with rotator housing 23 and a horizontally oriented upper ice tray 20 with its rotator housing 22. Control housing 10 is also attached to frame 6.

Flexible refrigerant hoses 18 connect upper tray 20 to housing 10, while corresponding hoses 19 connect to lower ice tray 21. Fixed housings for the two looped hose bundles 18 and 19 have been removed for this illustration.

Prechilled water at just above the freezing point enters at 9 and is distributed by manifold and drip tubes 7 to upper horizontal tray 20 while manifold and drip tubes 8 serve the same function for lower horizontal tray 21. While dual horizontal ice trays are shown in this embodiment, an ice making machine with only one horizontal freezing tray or with as many as three stacked horizontal freezing trays may be configured to serve the desired capacity. A single ice tray system will be described in the following detailed discussion. Implementation on two separate floors of a building as illustrated is also not required; a conveyor can be placed within frame 6 on a single floor of a building. The prechilled water from which ice is made can be supplied by a separate chiller or by a heat exchanger on the, evaporator line.

Figure 2:
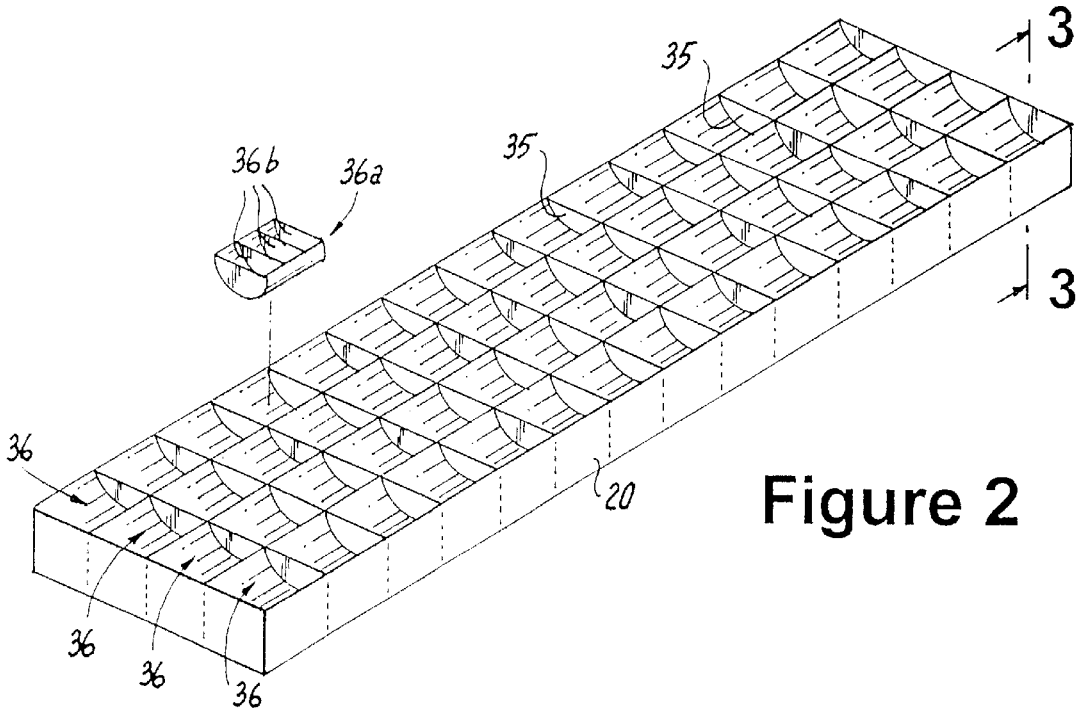
FIG. 2 is a Perspective view of an ice tray of this invention.

FIG. 2 shows horizontally oriented ice tray 20 which includes one or more attached troughs 36, such as four, with ice segment separators 35.

Figure 3:
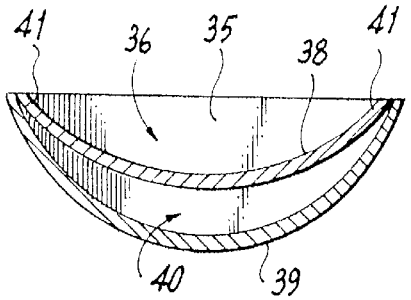
FIG. 3 is a Crossection view of an ice tray channel.

FIG. 3 is a crossection of a trough 36 showing inner ice forming surface 38 which is circular attached at edges 41 to outer layer 39 which is also circular, but of a smaller radius. This construction creates an enclosed space 40 through which refrigerant is conducted. The material for the trough can be copper which is brazed at edges 41 and then nickel plated. Other materials of high heat conductivity can be used as well. Welded stainless steel construction can be used for making brine ice for low temperature applications.

As seen in FIG. 3, enclosed space or passageway 40 is crescent shaped in cross section. It is understood that water resting on surface 38 would freeze if liquid refrigerant is permitted to evaporate within space 40; similarly, hot refrigerant vapors in space 40 would tend to condense melting ice in contact with surface 38. Ice segment separators 35 are similarly attached as by brazing or welding; they are made of the same material as the two layers of the trough.

Figure 4:
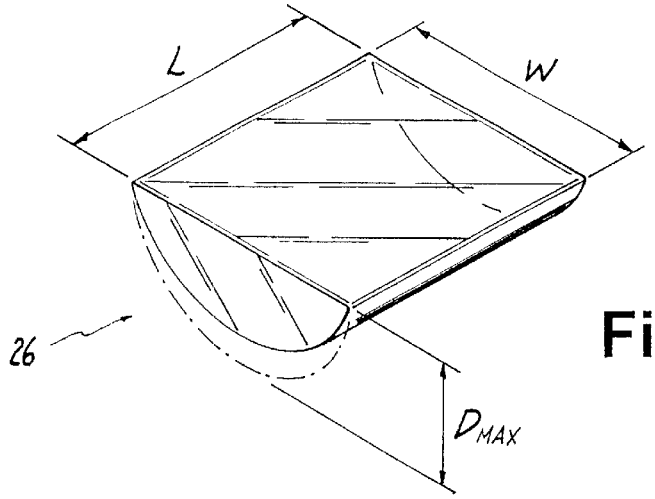
FIG. 4 is a Perspective view of an ice segment as produced by the apparatus of this invention.

FIG. 4 shows ice segment 26 with width W, length L and depth D. The maximum depth, Dmax, would be W/2 thereby making the end contour into a semicircle. It has been found that a more shallow configuration dumps easier (shorter cycle time). Length L can be much longer than W if desired for some applications; this is regulated by the placement of spacers 35.

Figure 5:
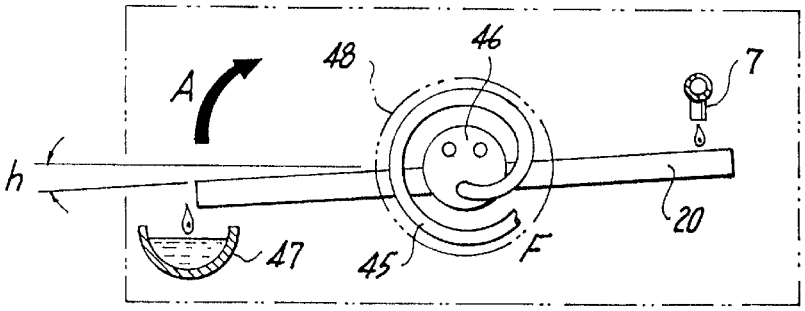
FIG. 5 is an End view of freezing tray in the fill/freezing position.
Figure 6:
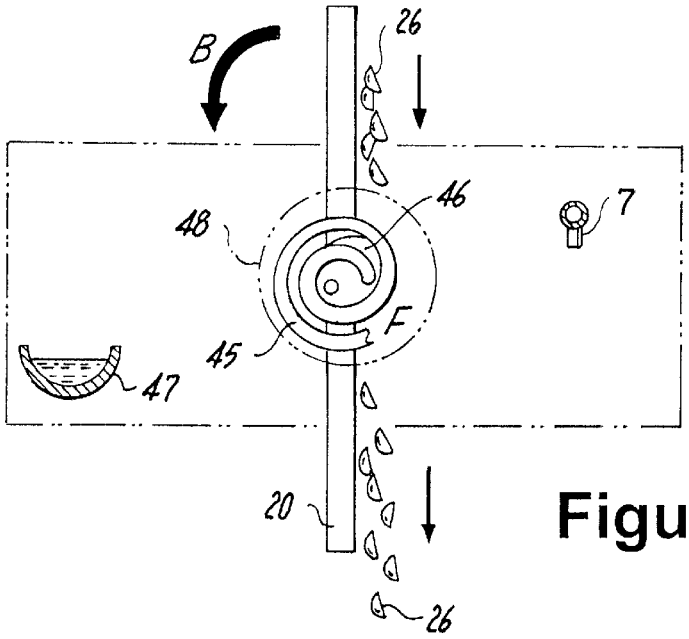
FIG. 6 is an End view of freezing tray in the ice cube dump position.

FIGS. 5 and 6 show two positions of ice tray 20. In FIG. 5, it is in a slightly tilted position from horizontal (angle "h") to facilitate filling from drip tubes 7 with any overflow of chilled water captured and returned in trough 47. After the filling period, the water in horizontal tray 20 is frozen while in this position.

Typically, 3 hoses are attached to each horizontal tray 20, two smaller evaporator hoses (approximately ⅜" diameter) and a suction hose (about ½" diameter). These types of hoses are currently used to carry refrigerant in truck mounted units. In this figure only the vapor hose 45 is shown so as to more clearly illustrate the spiral shape of the flexible connection from tray hose plate 46 to fixed attachment end at "F". Housing 48 would occupy the outline as shown.

After the ice is formed, horizontally oriented tray 20 is rotated clockwise (A) into the vertical position shown in FIG. 6. Note that the spiral of hose 45 is now tighter. When "thaw" heating is applied while in this position, ice segments 26 are dumped from tray 20. After the dumping cycle is complete, tray 20 is rotated counterclockwise (B) back to the horizontal position for the next ice making cycle.

Figure 7:
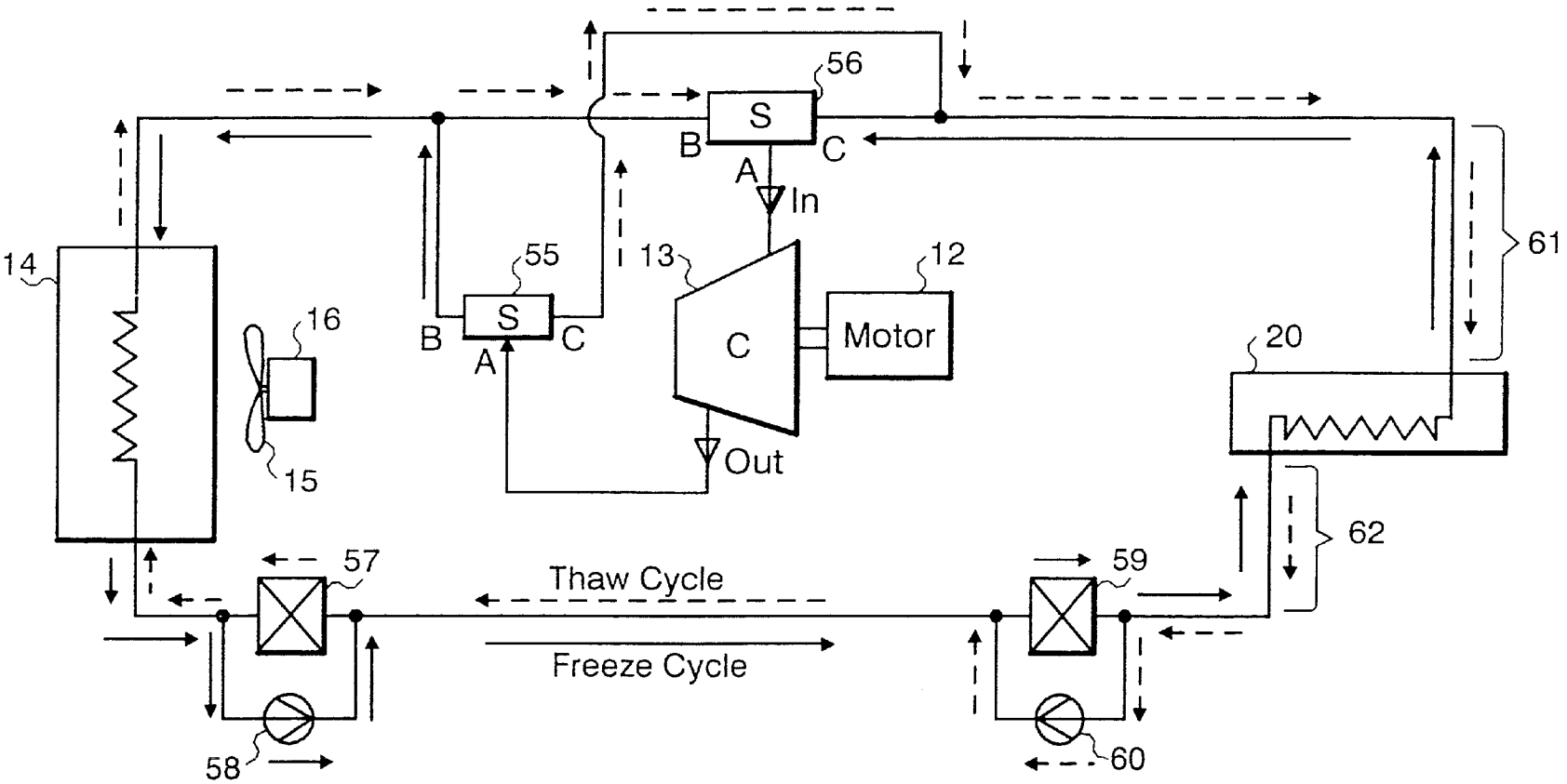
FIG. 7 is a Plumbing schematic of this invention showing fluid paths for both freezing and "thaw" cycles.

Both the ice making (freezing) cycle as well as the thaw cycle flow are shown on the flow schematic of FIG. 7. In addition to components already mentioned, expansion/throttle valve 57 with bypass check valve 58, expansion/throttle valve 59 with bypass check valve 60, as well as 3-port solenoid valves 55 and 56 are shown.

In the freeze cycle (shown by solid arrow shafts), liquid refrigerant flows through expansion valve 59 into ice tray 20 where it evaporates by extracting heat from ice water thereby freezing it. Suction is drawn from horizontal tray 20 by a path from orifice "C" to orifice "A" of solenoid 56 to the input of compressor 13. Refrigerant vapors are compressed and emerge from compressor 13 as hot vapors through orifice "A" to orifice "B" of solenoid 55 and onward to heat exchanger 14 which is now acting as a condenser with liquid refrigerant flowing through check valve 58 to complete the cycle.

For the thaw cycle (shown by dashed arrow shafts), liquid refrigerant flows through expansion valve 57 into heat exchanger 14 which now acts as an evaporator extracting heat from environmental air to vaporize refrigerant. Suction is drawn from heat exchanger 14 by a path from orifice "B" to orifice "A" of solenoid 56 to the input of compressor 13. Compressed hot vapors aid emerge from compressor 13 through orifice "A" to orifice "C" of solenoid 55 and onward to ice tray 20 which now acts as a condenser giving up heat to melt a surface of ice segments whereby refrigerant is condensed to a liquid which flows through check valve 60 to complete the cycle. Note that segments of piping 61 and 62 denote flexible hoses.

Certain controls and electrical wiring are required to support the activity described in FIG. 7.

Figure 8:
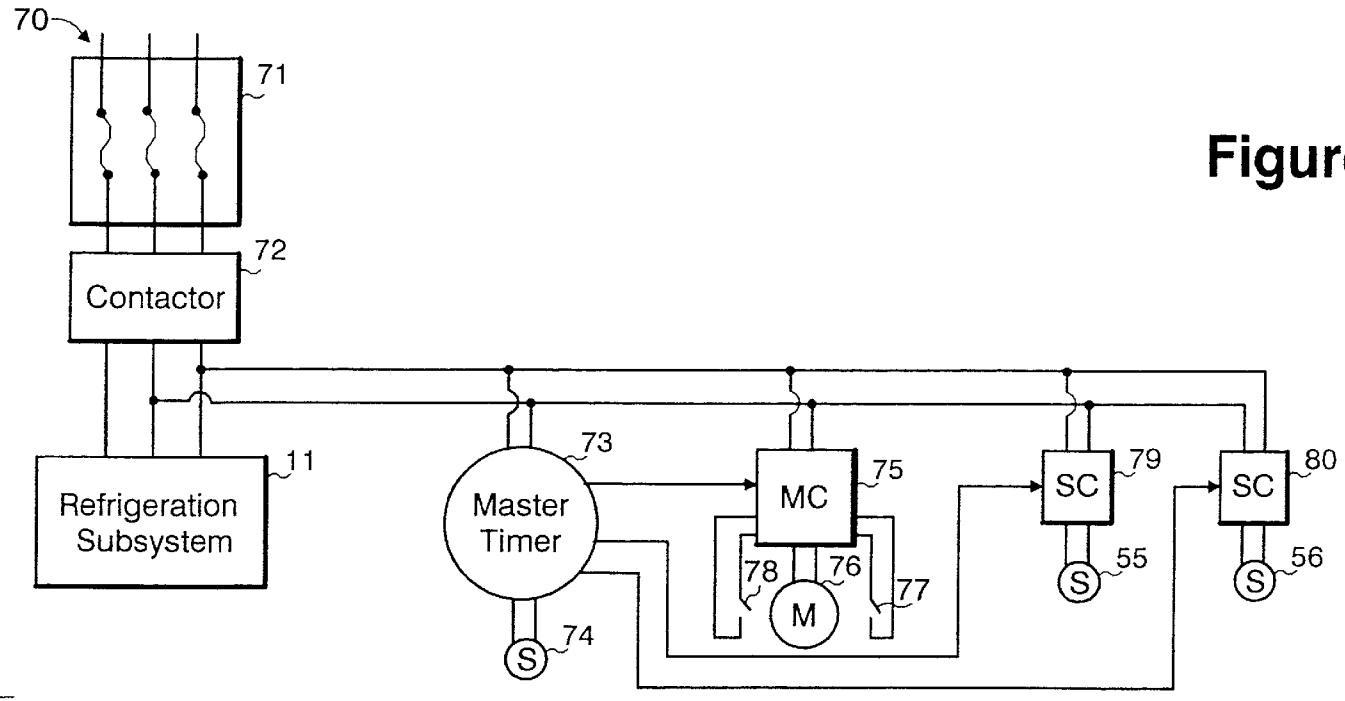
FIG. 8 is an Electrical block diagram of this invention.

For example, FIG. 8 is an electrical block diagram which describes the functioning of this invention. Either three phase AC or single phase 3-wire utility electricity enters at 70. Utility box 71 contains protection fuses. Contactor 72 applies power the entire ice making system including refrigeration subsystem 11. A master timer 73 controls the timing of the various components; solenoid 74 which controls the filling of ice tray 20 is directly controlled. Motor controller 75 gets its timing cue from master timer 73 to initiate the operation of motor 76 which changes the position of tray 20 form one position to the alternate position. Limit switch 78 stops motor 76 when tray 20 has reached the fill position; limit switch 77 stops motor 76 when tray 20 has reached the vertical position. Solenoid controllers 79 and 80 control solenoids 55 and 56 respectively upon cues from master timer 73. While illustrated as an open-loop control, timer 73 can be enhanced with feedback sensors such as temperature and/or refrigerant pressure sensors; however, since operating conditions should be quite invariant once initially set up, this refinement may not significantly improve efficiency and can contribute to unreliable operation.

Figure 9:
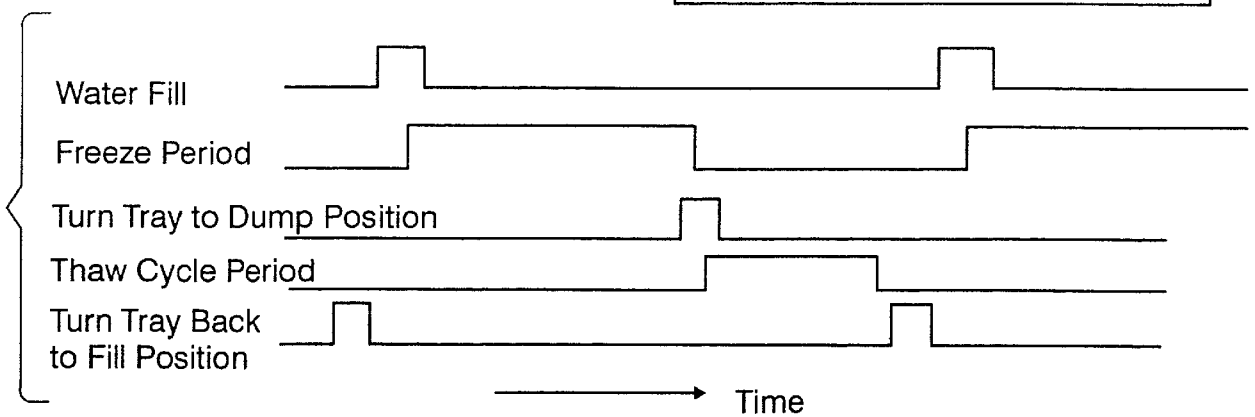
FIG. 9 is a Timing diagram of ice making cycle of this invention.

FIG. 9 shows a timing diagram of the various operations. The timing relationships, durations, and overlap can be seen for a typical installation. A total cycle time for making an ice batch of ten minutes is achievable with proper matching of the various parameters. This would be illustrated by the chart distance from the start of a "water fill" pulse to the next. Water filling, freeze periods, dump turning, thaw periods, and fill turning are illustrated in the timing diagram.

FIGS. 10, 11, 12 and 13 show alternate embodiments with respect to the horizontal orientation of the freezing tray.

Figure 10:
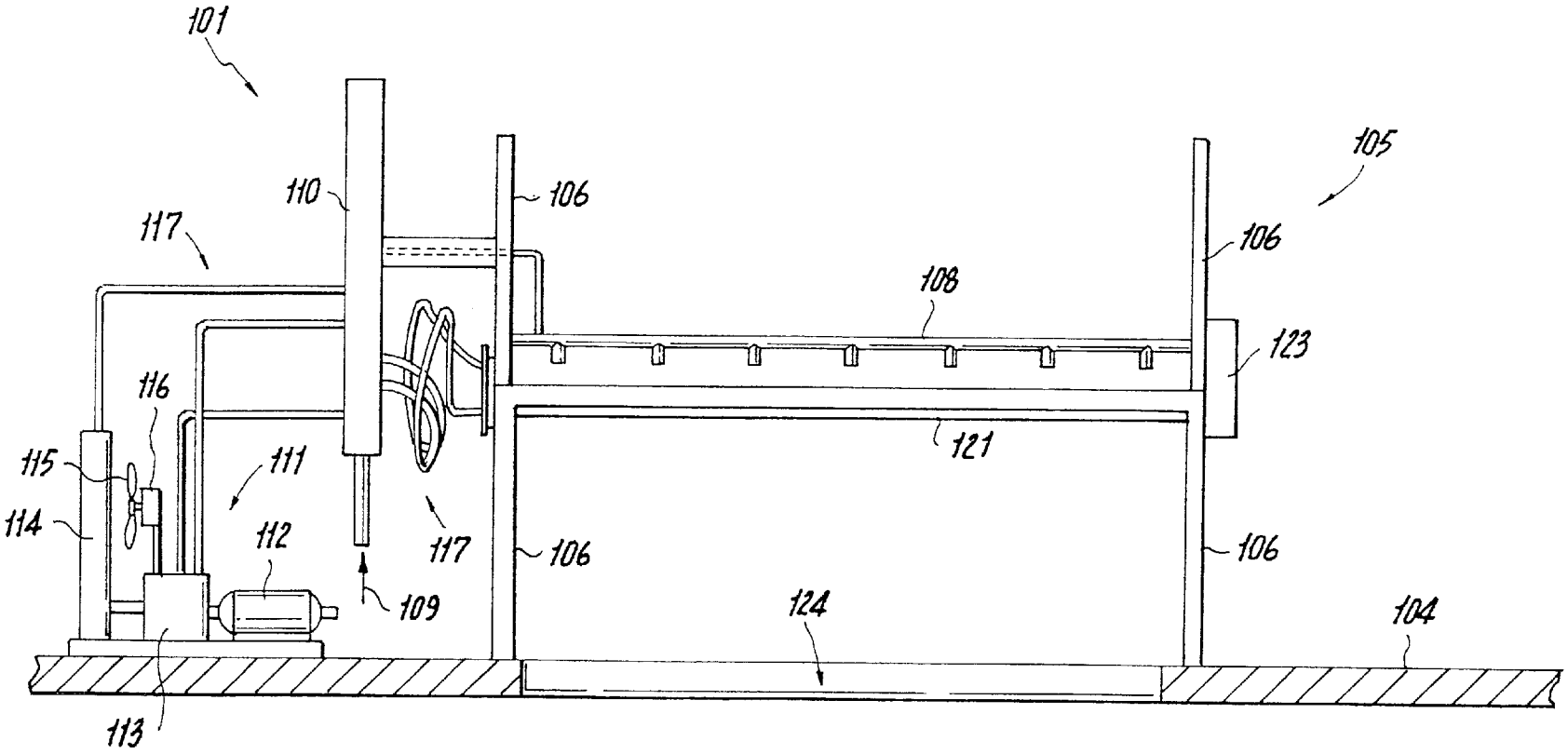
FIG. 10 is a Side elevation view of an alternate embodiment for an ice making system having a countertop display and a removable water inlet source, shown in the water introduction phase.
Figure 11:
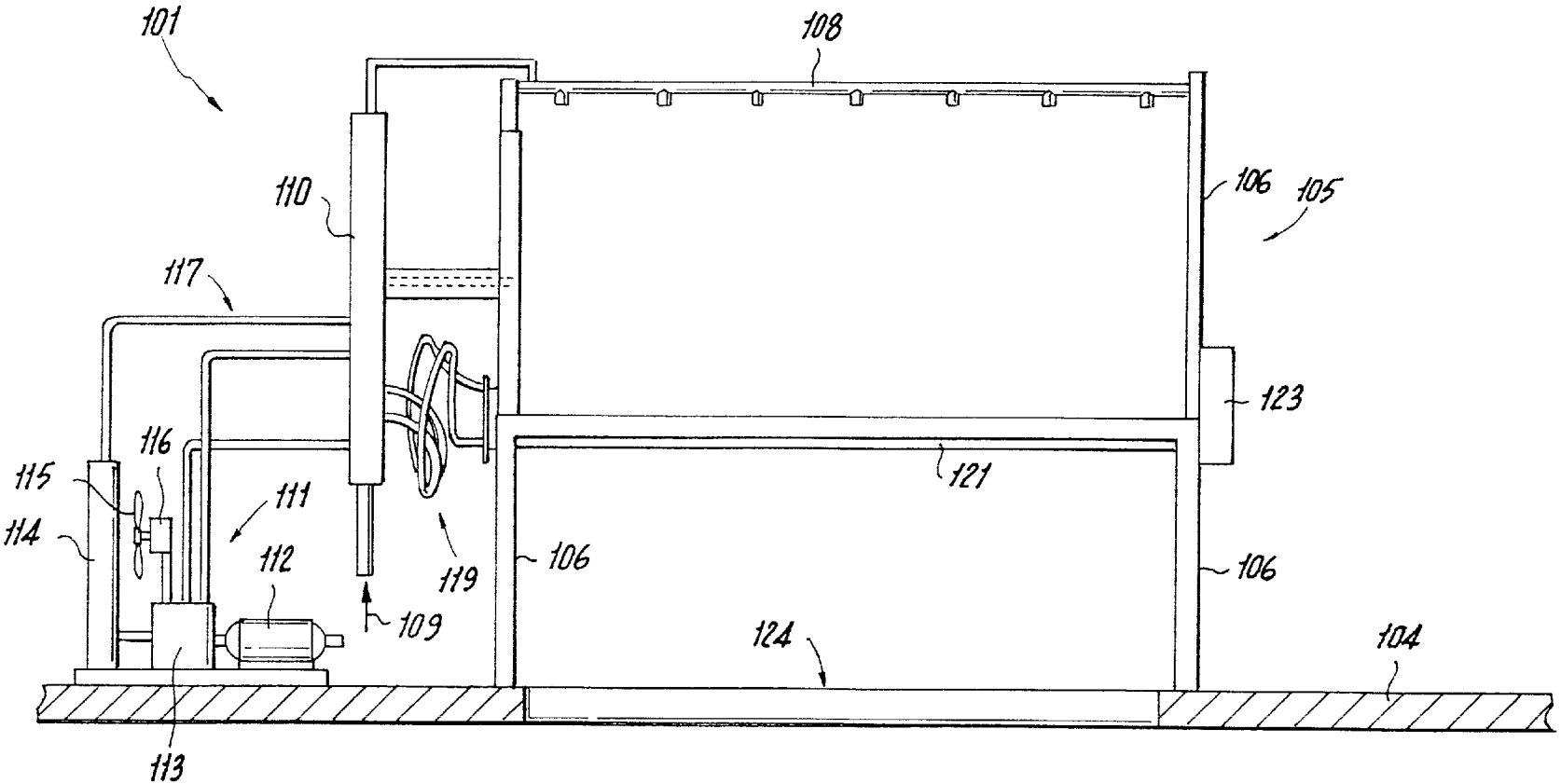
FIG. 11 is a Side elevation view of the alternate embodiment as in FIG. 10 for an ice making system having a countertop display, with the water inlet source shown removed upward away from the countertop display.
Figure 12:
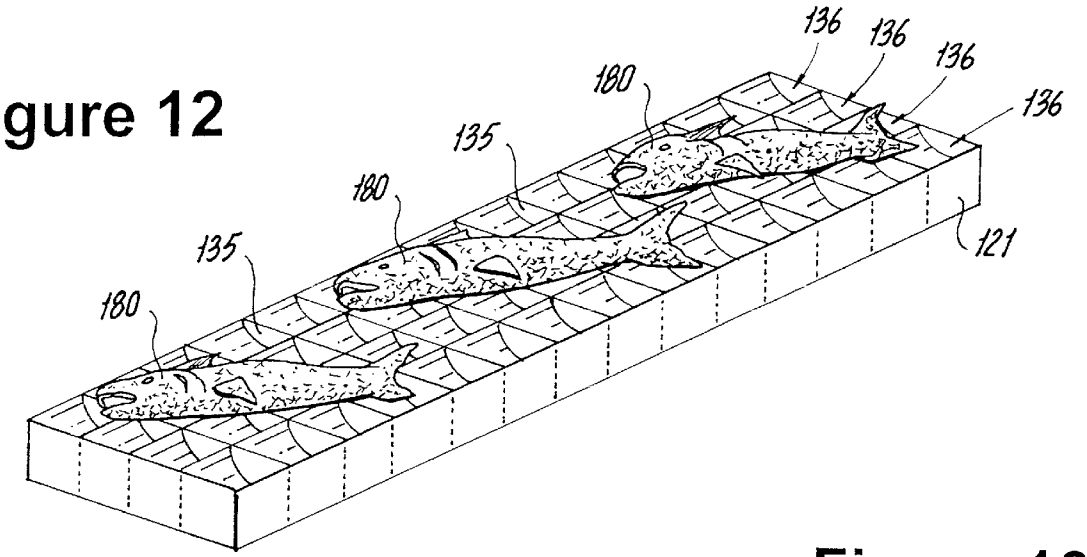
FIG. 12 is a Perspective view of the countertop freezing tray portion of the embodiment of FIGS. 10 and 11, shown with fish displayed thereon; and, FIG. 13 is a Perspective view of an alternate embodiment for an ice tray functioning as a physical therapy bed, shown with a user lying thereon.

In FIGS. 10 and 11, inlet drip tubes 108 are shown close to freezing tray 121 for introducing water, and then inlet drip tubes 108 lifted out of the way as in FIG. 11, so that tray 121 can be used as a counter-top for displaying fish for sale at a fish store, as shown in FIG. 12.

FIGS. 10–12 presents an illustration of an embodiment of this invention as a countertop display ice making system 101. The ice making apparatus 105 rests on support floor 104 which has an optional drain opening 124 communicating with the floor 104. A vapor compression refrigeration system 111 (part of ice making apparatus 105) includes compressor motor 112, compressor 113, fan motor 116, fan 115, heat exchanger 114, and rigid refrigerant lines 117.

Frame 106 supports a liftable or removable horizontally oriented ice tray 21 with lift mechanism 123. Control housing 110 is also attached to frame 106.

Flexible refrigerant hoses 119 connect horizontal countertop tray 121 to housing 110.

Prechilled water at just above the freezing point enters at inlet 109 and is distributed by manifold and drip tubes 108 to horizontal countertop freezing tray 121. While liftable horizontal countertop ice tray 121 is shown in this embodiment, an ice making machine with a removable or horizontally shiftable horizontal countertop freezing tray or trays 121 may be configured to serve the desired capacity. The prechilled water from which ice is made can be supplied by a separate chiller or by a heat exchanger on the evaporator line.

FIG. 12 shows horizontally oriented countertop ice tray 121 displaying fish 180 thereon. Tray 121 includes one or more attached troughs 136, such as four, with ice segment separators 135.

Figure 13:
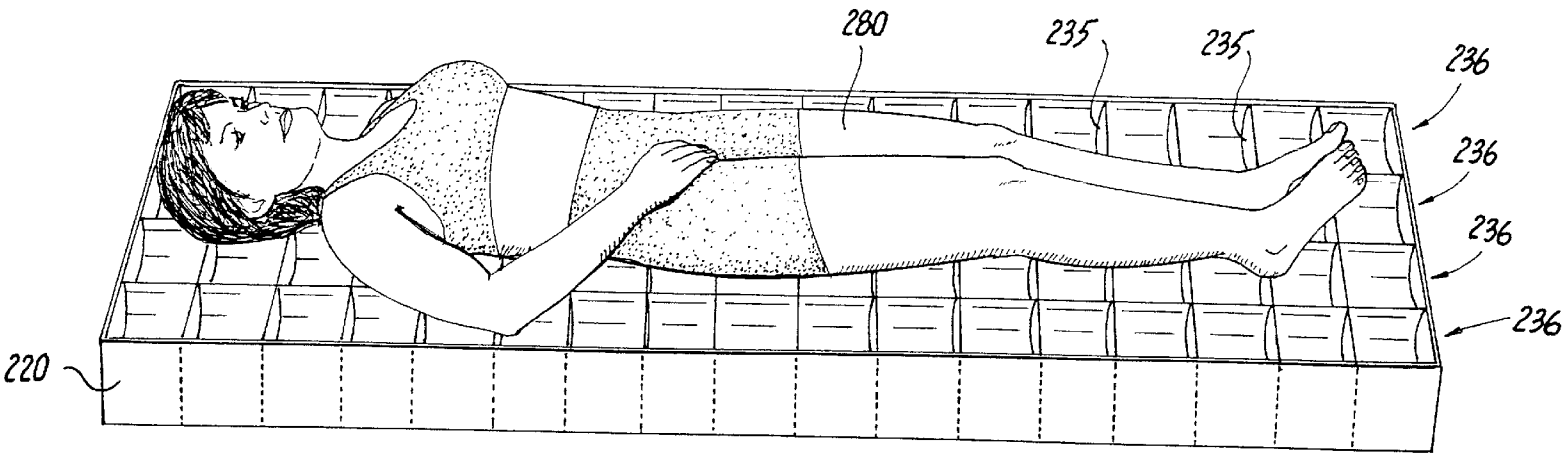

FIG. 13 shows an even further alternate embodiment where the horizontal freezing tray 220 is used as a physical therapy bed device for a human patient 280 with a need for ice application to the back, neck or limbs. FIG. 13 shows corresponding attached troughs 236 with ice segment separators 235. It is anticipated for user comfort that the tops of troughs 236 and separators 235 are covered with an soft elastomeric material, such as rubber or synthetic materials such as polyurethane foam.

Furthermore, in the embodiments of FIGS. 10–13 where the ice can remain in place and does not have to be dumped until melted after use as a display countertop or physical therapy bed, then the introduction of hot gas in the curved hollow sleeves under respective ice segment compartments 136 or 236 can be optional if the ice formed just stays in place until melted, such as in a fish display or in the physical therapy bed embodiment. In that case one would only need the refrigerant to flow through hollow arcuate sleeves similar to hollow arcuate sleeves 40 in FIGS. 1–3 herein, to freeze the water in horizontal countertop tray 121 of FIG. 12 or physical therapy bed 221 of FIG. 13.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A commercial ice making method for producing commercial ice in convenient sizes for at least one of mobile food carts, market produce, or fish displays comprising the steps of:

introducing water into hollow walls of an elongated mold in an ice forming freezing tray oriented substantially horizontal, said hollow walls comprising an inner, circular wall into which said water is introduced and an outer, circular wall spaced from said inner wall forming a crescent shaped passageway extending the length of said mold, said mold having dividers in said inner wall forming separate ice forming compartments;

passing refrigerant through said crescent shaped passageway to supercool water in said compartments forming ice segments to a temperate below 0 degrees F.;

rapidly subjecting said supercooled ice segments to a short, temporary contact with a high heat source by momentarily passing a heated fluid through said passageway to melt a thin layer of ice adjacent said inner wall;

rotating said tray containing said ice segments to a substantially vertically oriented dump position whereby said ice segments are dumped from said mold into a collection bin.

2. The commercial ice making method as in claim 1 in which exposure to said high heat source is carried out by reversibly cycling said refrigerant thereby creating said thin layer of water lubricating and dislodging said ice segments while said tray is in a vertical dumping position, said thin liquid interface layer quickly refreezing upon said dumped ice cube segments being dumped into said collection bin due to the supercooled temperature of said ice segments.

3. The commercial ice making method as in claim 1 wherein said tray is tipped slightly during filling of said mold with water whereby excess water after said mold compartments are filled flows over a lower end of said mold into a trough, said tray being righted into a horizontal position after said compartments are filled with water for freezing, all of the water for said mold coming from a dispenser located adjacent a higher end of said mold.

4. The commercial ice making method as in claim 1 wherein rotating of said freezing tray is facilitated by the use of loops of flexible refrigerant hoses.

5. The commercial ice making method as in claim 4 wherein in a freeze cycle said liquid refrigerant flows through an expansion valve into said passageway, whereupon said refrigerant evaporates by extracting heat from said water thereby freezing said water into said ice segments, whereby further said refrigerant flows to a heat exchanger acting as a condenser with said liquid refrigerant flowing therethrough.

6. The commercial ice making method as in claim 5 wherein said liquid refrigerant flows through said expansion valve into said heat exchanger acting as an evaporator extracting heat from ambient air to vaporize said liquid refrigerant, wherein suction is applied to said vaporized refrigerant from said heat exchanger to a compressor and onward to said passageway, which said freezing tray is subject to said temporary high heat source through said passageway and said freezing tray acts as a condenser giving up heat to temporarily melt bottom surfaces of said ice segments.

7. The commercial ice making method as in claim 6 wherein use of said crescent shaped passageway in intimate contact with said freezing tray promotes rapid heat transfer, causing short ice batch formation cycles thereby providing high throughput of said ice segments.

8. A commercial ice making apparatus for producing commercial ice in convenient sizes for at least one of mobile food carts, market produce, or fish displays comprising:

a substantially horizontal freezing tray comprising rows of elongated molds;

each mold comprising an upper curved wall extending the length of said mold forming an upwardly facing concave surface divided into compartments by a plurality of spaced separators and a lower curved wall forming a crescent shaped passageway through the length of said mold, said upper and lower curved walls being joined at edges thereof;

an inlet introducing water into said molds;

means for introducing vapor compression refrigerant into one end of each passageway for making intimate contact with said compartments to produce a plurality of ice segments in said compartments;

said refrigerant adapted to supercool said ice segments to a temperature below 0 degrees F.

9. The commercial ice making apparatus as in claim 8 further comprising a timer rapidly subjecting said supercooled ice segments to a short, temporary contact with a high heat source in said passageway.

10. The commercial ice making apparatus as in claim 9 further comprising a rotator for rotating said freezing tray containing ice segments to a vertically oriented dump position for dumping said temporarily heated ice segments from said freezing tray into a collection bin.

11. The commercial ice making apparatus as in claim 10 further comprising a reversible cycle heat pump alternately cycling said refrigerant and said high heat source into said passageway for a brief thaw cycle, thereby creating a thin layer of water at an interface between said ice segments and a surface of said freezing tray, thereby lubricating and dislodging said ice segments while said tray is in a vertical dumping position, said thin liquid layer quickly refreezing upon said dumped ice cube segments being dumped due to the supercooled temperature of said ice segments.

12. The commercial ice making apparatus as in claim 8 wherein said water inlet source is removable away from said horizontal freezing tray, exposing said freezing tray for display of objects thereon.

13. The commercial ice making apparatus as in claim 12 further comprising said compartments of said freezing tray being shallow with an increased a radius of arc of said compartments and a decreased a vertical height thereof.

14. The commercial ice making apparatus as in claim 9 wherein in a freeze cycle said refrigerant is a liquid which flows through an expansion valve into said freezing tray, whereupon said refrigerant evaporates by extracting heat from said water thereby freezing said water into said ice segments, whereby further said refrigerant flows to a heat exchanger acting as a condenser with said liquid refrigerant flowing therethrough.

15. The commercial ice making method as in claim 14 wherein said liquid refrigerant flows through an expansion valve into said heat exchanger acting as an evaporator extracting heat from ambient air to vaporize said liquid refrigerant, wherein suction is applied to said vaporized refrigerant from said heat exchanger to a compressor and onward to said passageway, which said freezing tray is subject to said temporary high heat source through said passageway and said freezing tray acts as a condenser giving up heat to temporarily melt said bottom surfaces of said ice segments.

16. The commercial ice making machine as in claim 14 wherein said temporary heat source is augmented by additional flow of said temporary heat source through at least one bypass pipe to said passageway.

17. The commercial ice making as in claim 14 wherein at least one non-metallic spacer with sub-compartments is inserted into said compartments prior to entry of water thereto.

18. The commercial ice making machine of claim 8 having means to slightly tilt said freezing tray during filling of said compartments with water, a trough being positioned to collect surplus water after said compartments are filled with water, said tilt means rotating said freezing tray to a horizontal position for freezing of water in said compartments after said compartments are filled with water.

* * * * *